US006364787B1

(12) United States Patent
Huiskamp

(10) Patent No.: US 6,364,787 B1
(45) Date of Patent: Apr. 2, 2002

(54) GOLF CLUB WITH ADVANTAGEOUS WEIGHT DISTRIBUTION

(76) Inventor: Robert W. Huiskamp, 1537 Long Rd., Kalamazoo, MI (US) 49008

( * ) Notice: Subject to any disclaimer, the term of this patent is extended or adjusted under 35 U.S.C. 154(b) by 0 days.

(21) Appl. No.: 09/356,088

(22) Filed: Jul. 16, 1999

(51) Int. Cl.[7] ..... A63B 53/08; A63B 53/00

(52) U.S. Cl. ..... 473/294; 473/292; 473/297

(58) Field of Search ..... 473/297, 298, 473/299, 226, 223, 206, 296, 457, 549, 552, 294

(56) References Cited

U.S. PATENT DOCUMENTS

| | | | | |
|---|---|---|---|---|
| 1,528,190 A | | 3/1925 | Howe | |
| 1,696,462 A | * | 12/1928 | Victor | 473/297 |
| 1,709,546 A | | 4/1929 | Stanton | |
| 2,178,872 A | | 3/1939 | Engstrom | |
| D201,250 S | * | 6/1965 | Martinez | 473/294 |
| 3,606,327 A | | 9/1971 | Gorman | |
| 4,461,479 A | | 7/1984 | Mitchell | |
| 4,600,195 A | | 7/1986 | Hunter | |
| 5,308,072 A | | 5/1994 | Pettinelli | |
| 5,364,102 A | * | 11/1994 | Appledorn | 273/162 R |
| 5,390,921 A | | 2/1995 | De Ruyter | |
| 5,452,891 A | * | 9/1995 | Thomas | 473/294 |
| 5,465,967 A | | 11/1995 | Boeckenhaupt | |
| 5,554,078 A | | 9/1996 | Hannon | |
| 5,616,087 A | * | 4/1997 | Bothwell | 473/294 |
| 5,649,870 A | | 7/1997 | Harrison | |
| 5,672,117 A | * | 9/1997 | Dar | 473/294 |
| 5,766,088 A | | 6/1998 | Severtsen | |
| 5,800,283 A | * | 9/1998 | Nomura | 473/294 |
| 5,830,081 A | * | 11/1998 | Kitahara | 473/294 |
| 5,830,082 A | * | 11/1998 | White | 473/294 |
| 5,855,524 A | * | 1/1999 | Jenkins | 473/294 |
| 5,904,626 A | * | 5/1999 | Fendel et al. | 473/296 |
| 5,906,548 A | * | 5/1999 | Hadge | 473/206 |
| 6,068,562 A | * | 5/2000 | Hedges | 473/294 |
| 6,213,890 B1 | * | 4/2001 | Prince | 473/292 |

FOREIGN PATENT DOCUMENTS

| | | |
|---|---|---|
| AU | PCT/AU82/00182 | 5/1983 |
| EP | 0 227 347 | 7/1987 |
| GB | 2 344 767 | 6/2000 |

* cited by examiner

*Primary Examiner*—Jeanette Chapman
*Assistant Examiner*—Sneh Varma
(74) *Attorney, Agent, or Firm*—The Firm of Hueschen and Sage; G. Patrick Sage

(57) ABSTRACT

A golf club wherein a redistribution of weight is provided to increase the moment of inertia but to decrease the swing weight of the club and thus allow increased velocity about the pivot point of the club when using the same energy input or swing, by means of a hollow tubular extension of one to six inches, preferably three to five inches, bearing a weight of 25 to 200 grams, preferably 50 to about 100 grams, at the end of the hollow tubular extension, which weight is thereby upwardly spaced from the gripping surface of the club so as to place the added weight in alignment with the vertical or longitudinal axis of the club shaft and behind the hands of the golfer during a swing, as well as such an extension comprising an adapter for converting a normal golf club to such a club.

11 Claims, 5 Drawing Sheets

GOLF CLUB WITH ADVANTAGEOUS WEIGHT DISTRIBUTION

BACKGROUND OF THE INVENTION

1. Field of the Invention

The field of the present invention is golf clubs and in particular golf clubs having an advantageous or improved weight distribution.

2. Prior Art

The prior art is replete with golf clubs of all kinds and descriptions, some relating to allegedly improved weight distribution.

A search was conducted in the appropriate U.S. Patent Office classifications as follows: Class 434, subclass 252; Class 473, subclasses 256, 282, 291, 292, 297, 298, 307, 308, and 316. The search did not show or suggest the golf club according to the present invention, although it did show, as expected, that weights oriented on the handle or gripping end of a golf club are notoriously old. Copies of the most relevant patents are provided herewith. U.S. Pat. No. 1,696,462 of 1928 shows a weighted attachment at the very end of the handle of a golf club. Over the years, alleged improvements have been made and various changes in the basic concept have arisen, some for entirely different end purposes. U.S. Pat. No. 4,600,195 shows the addition of a plurality of weights at the very end of the gripping or handle end of the club and extending continuously outwardly, and U.S. Pat. No. 5,308,072 discloses an offset counterweight structure which is out of alignment with the longitudinal or vertical axis of the club shaft. Such weights may be detachable as disclosed in U.S. Pat. No. 1,696,462. Other patents turned up in the search were U.S. Pat. Nos. 4,461,479, 5,308,072, 5,452,891, 5,554,078, 5,649,870, and 5,766,088, most of these relating only to the elongation of the gripping surface of a golf club, especially a putter, or various means for increasing or changing the weight at the handle or gripping end of the club. An extension of the search to include the references cited during prosecution of those patents failed to show anything more relevant, but copies of U.S. Pat. Nos. 1,528,190, 1,709,546, 2,178,872, and 3,606,327 are nevertheless also provided herewith.

U.S. Pat. Nos. 1,696,462 and 4,600,195 attempt to improve the weight distribution by adding weight at the very end of the club shaft opposed to the club head, but this has actually proved to be disadvantageous in practice as merely adding weight at the gripping end of the club at or about the pivot point thereof, which in fact only makes the "handle" of the club heavier with respect to the rest of the club and not only increases the moment of inertia but also increases the swing weight of the club with its accompanying disadvantages, while an out-of-alignment counterweight as in U.S. Pat. No. 5,308,072 makes it difficult to maintain a uniform or constant directional pattern during the course of a swing or swings.

OBJECTS OF THE INVENTION

It is an object of the present invention to provide a golf club having an advantageous weight distribution which increases the moment of inertia but decreases the swing weight of the club and thus allows the golfer to attain an increased velocity about the pivot point of the club while using the same amount of energy input or the same swing as the golfer would employ with a normal club. It is another object of the invention to provide a golf club in which a weight is provided at a point which is spaced upwardly toward the golfer from the normal pivot point of the club and from the normal gripping end thereof so as to provide a club which fulfills the first objective of the invention. Another object of the invention is to provide a golf club in which the weight added beyond the gripping end of the club is between about 25 and 200 grams, preferably about 50 to about 100 grams, and wherein said weight is spaced between one inch and six inches, preferably about three inches to five inches, above the normal gripping end of the club. It is a further object of the invention to provide a golf club of the type described wherein the added weight is thus provided behind the hands of the golfer at the end of a spacer or extension thereof and, with respect to the club, considerably above the normal pivot point thereof. It is another object of the present invention to provide a weighted extension comprising an adapter for use in modifying an existing golf club of conventional type to provide the structure and advantages of the present invention. Additional objects of the invention will become apparent hereinafter and still others will be obvious to one skilled in the art.

THE PRESENT INVENTION

According to the present invention, improved weight distribution, swing weight and distance is attained by provision of a golf club having a hollow tubular shaft from the head or shank end to the gripping or handle end thereof, and a hollow tubular extension beyond the handle or gripping end of the club and the normal gripping surface thereof which provides a distance of one to six inches beyond the club end, at the end of which is provided a weight of 25 to 200 grams. When the extension is provided by means of an adapter, an additional segment or extension must be added to the extension so the same may be fixedly secured inside of or around the hollow shaft of the golf club itself at the handle or gripping end thereof. Both the extension and the weight at the end thereof must be axially aligned with the axis of the shaft, that is, the extension and the weight must be aligned with the vertical or longitudinal axis of the hollow golf club shaft. This places the weight at the end of the hollow extension axially in line with the club shaft and behind the golfer's hands during any swing of a club comprising the same for maximizing the effectiveness, direction, and distance attained by the swing, and not simply at the end of the golf club handle or gripping surface, where its effect is minimal or even negative although the mass of the golf club is increased in such case.

The hollow extension may be of the same metal or alloy as the shaft of the golf club itself, or of any other suitable metal or even strong rigid plastic material. As disclosed herein, the extension may even be in the form of a continuation of the shaft of the golf club itself beyond its normal end and beyond the gripping surface thereof. When the extension is provided with an adapter, the extension of the defined length is provided with an attachment feature, that is, a further extension thereof adapted to fit into or outside of the hollow shaft of the golf club proper at the end of the handle or gripping surface thereof and adapted to be secured in fixed engagement with said hollow shaft of the club at the end thereof.

SUMMARY OF THE INVENTION

What I believe to be my invention, then, inter alia, comprises the following, singly or in combination:

A golf club having a head end and a handle or gripping end and a hollow shaft therebetween, an elongated hollow tubular extension of the hollow shaft at the handle or gripping end thereof and beyond the gripping surface thereof, said extension being one to six inches in length and carrying a weight of 25 to 200 grams fixedly secured at the end thereof, said extension and said weight being aligned with the vertical or longitudinal axis of the shaft of the club, said extension spacing the weight upwardly beyond the gripping surface of the club and thus behind the golfer's hands upon gripping the club and above the pivot point of the club during the golfer's swing; such a golf club wherein the extension is provided as a continuation of the hollow shaft of the golf club itself which extends beyond the gripping surface thereof; such a golf club wherein the extension is provided with adapter means axially aligned therewith of an additional length sufficient to enable its securement at the end of the hollow golf club shaft for fixed engagement therewith in alignment with the vertical or longitudinal axis of said golf club shaft; such a golf club wherein the adapter means fits inside the end of a hollow golf club shaft and is fixedly secured therein; such a golf club wherein the length of the extension is about three to about five inches and the weight is about 50 to about 100 grams; and such a golf club wherein the club is an iron, a wood, or a putter.

Moreover, an elongated tubular extension for the handle or gripping end of a golf club having a hollow shaft, said extension being one to six inches in length and carrying a weight of 25 to 200 grams fixedly secured at one end thereof, said extension having at the other end thereof adapter means axially aligned therewith of an additional length sufficient to enable its securement at the end of the hollow golf club shaft for fixed engagement therewith in alignment with the vertical or longitudinal axis of said golf club shaft; such an extension wherein the adapter is designed for securement within the end of a hollow golf club shaft for fixed engagement therewith; and such an extension wherein the length of the extension is about three to about five inches and wherein the weight is about 50 to about 100 grams.

GENERAL DESCRIPTION OF THE INVENTION

DESCRIPTION OF THE DRAWINGS

Reference is now made to the drawings wherein.

DESCRIPTION OF THE PREFERRED EMBODIMENTS

Reference is now made to the drawings for a better understanding of the invention, wherein the same letters are used to refer to the same elements throughout.

Figure 1:
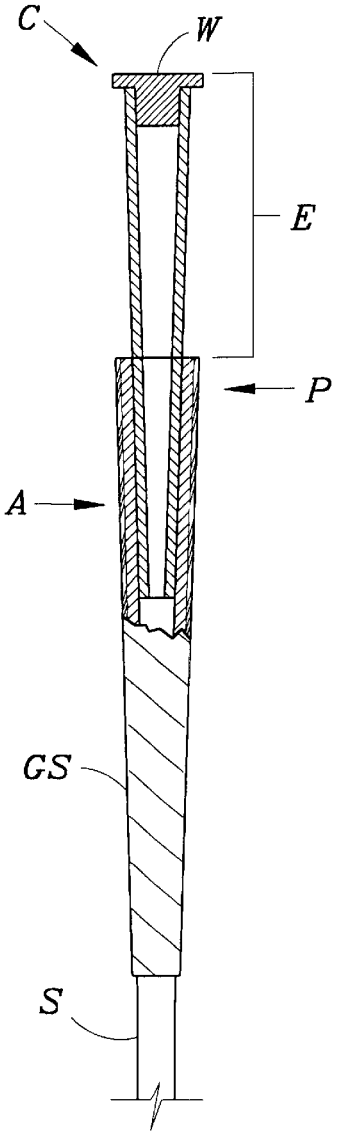
FIG. 1 is a view of the gripping portion of a golf club, partially cut away and partially in section, showing a golf club of the present invention as provided by utilizing an adapter, comprising an extension including a weight at the end of thereof, which is affixed to the gripping end of the hollow golf club shaft, with the weight and extension secured upwardly on the shaft by means of the adapter, the extension, adapter, and weight all being aligned with the longitudinal or vertical axis (X—X in FIGS. 1–3) of the shaft in all FIGS.

Referring now to FIG. 1, the upper or gripping end of a golf club is shown generally at C. The hollow shaft is shown at S, with the gripping surface of wound leather, leather substitute, rubber, rubber substitute, or composition being shown at GS. The pivot point of the club, at which point the golfer ordinarily places the little finger of his upper hand for gripping of the same, is shown at P, with a hollow extension according to the present invention being shown at E and comprising a weight W as shown at the upper end thereof. The weight W as shown is fixedly secured at the end of hollow extension E. An adapter at the lower end of extension E has a contour and circumference designed and tapered so as to fit snugly and be fixedly secured within the hollow shaft S of the club at the upper gripping end thereof opposed to the club head and above the normal gripping surface GS of the club. The adapter for the extension and weight is shown as A.

Although the shaft S of the club and extension E are both hollow, the adapter A is only preferably hollow and advantageously has a corresponding taper for convenient fitting into the end of shaft S as by crimping, swaging, splining, press fitting, or the like, and if desired also cemented in the interior of the shaft S. The weight W and the adapter A may be integral with hollow extension E and weight W is solid and of any suitable metal or alloy or other material as desired.

Alternatively, the adapter A can be conveniently fitted to the exterior of shaft S. If desired, the entire extension E, including or not including any exposed portion of weight W, may be taped or otherwise covered in the same manner as the gripping surface of the club. Adapter A of extension E is at any rate secured in fixed engagement with the end of the club just above the gripping surface thereof and consequently also just above the pivot point thereof when the club is in normal use by the golfer.

Figure 1A:
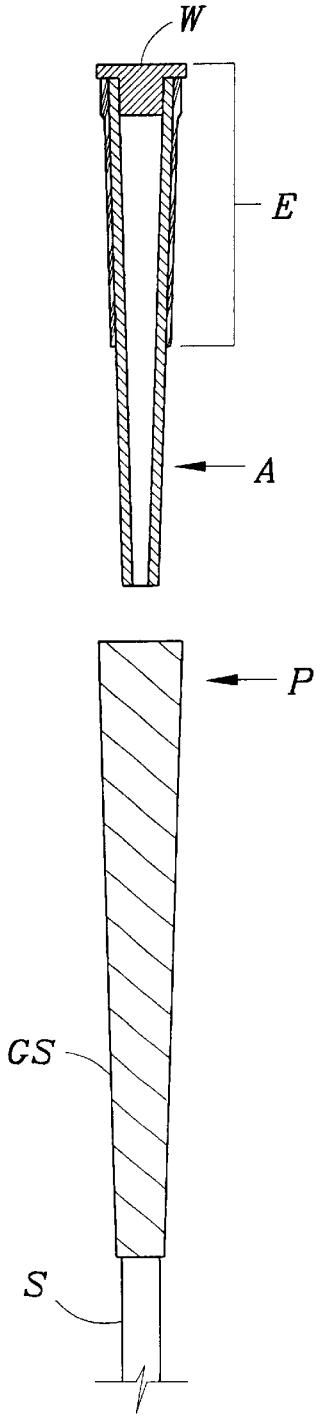
FIG. 1A is an exploded view, partially cut away and partially in section, of the gripping end of the golf club of FIG. 1, showing the upper end of the golf club shaft separated from the weighted extension and its adapter, which adapter is shown fixedly secured to, i.e., inserted within, the end of the hollow golf club shaft of FIG. 1.

In FIG. 1A the same embodiment as shown in FIG. 1 appears, but with the adapter A separated from the end of the hollow shaft S of the club and ready to be inserted thereinto and secured therein.

Figure 2:
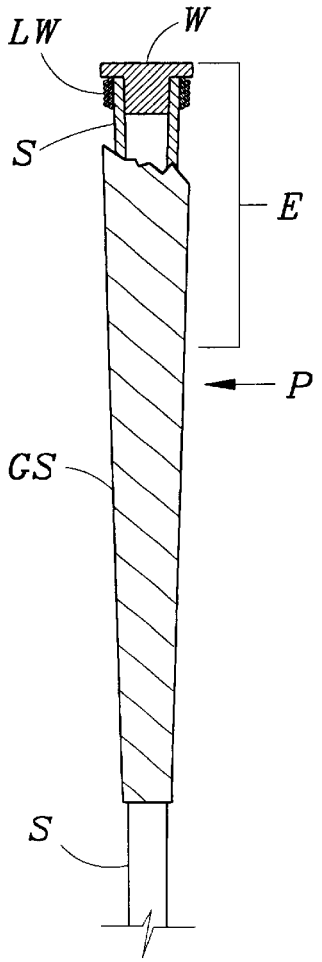
FIG. 2 depicts another version, partially cut away and partially in section, of a golf club according to the present invention, wherein the extension at the upper end of the golf club shaft is provided by simply extending the usual hollow shaft beyond the gripping surface of the club, the weight being provided at the uppermost end of this extension.

FIG. 2 shows another embodiment of the club according to the present invention wherein the hollow extension E is provided merely by extending the club hollow shaft S above the normal gripping surface GS of the club and above the normal pivot point P of the club, the shaft of normal length thus being integral with its extension E. At the end of extension E is affixed the weight W which, as shown, is secured in the end of the extension E of shaft S, and which is in this embodiment also in part provided by a lead winding or wrap LW outside the hollow shaft, which may or may not be integral with or affixed to the major weight W.

Figure 3:
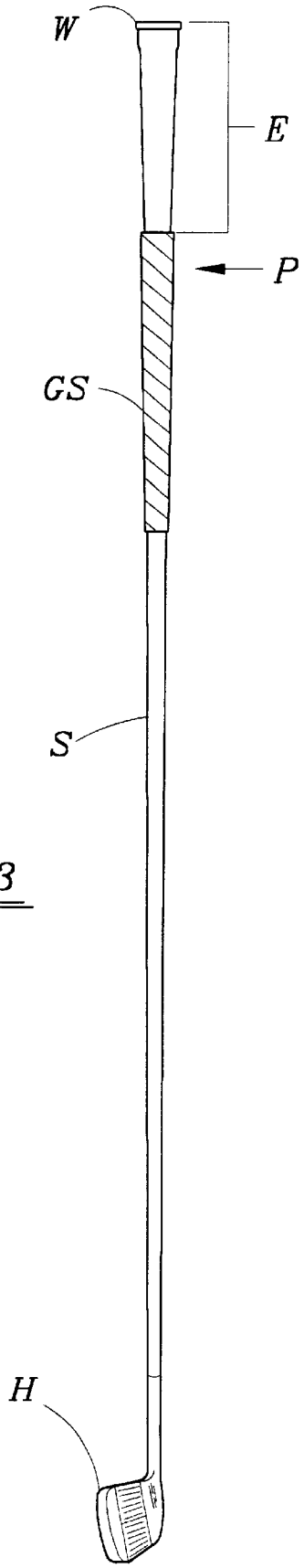
FIGS. 3, 4, 5, 6, 7, and 8 depict various embodiments of the club of the present invention wherein the golf club is an iron.
Figure 4:
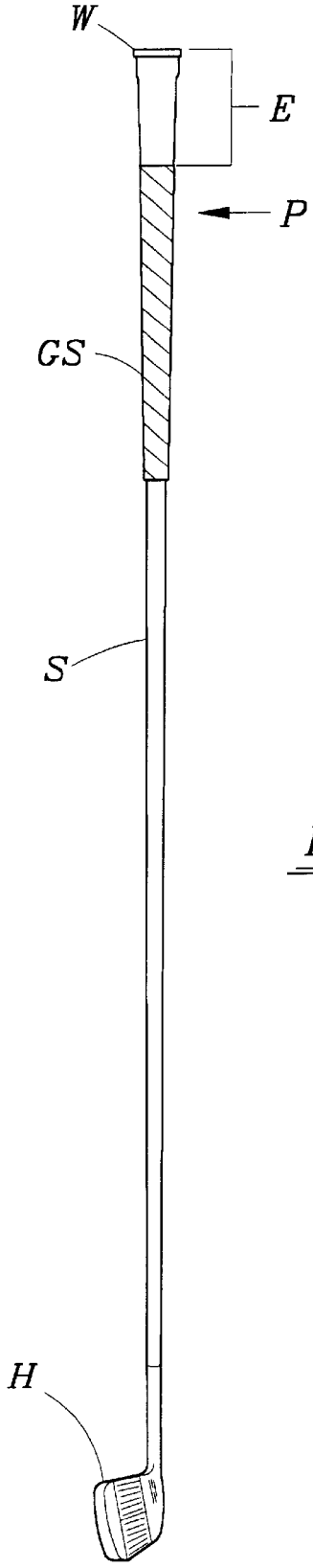
Figure 5:
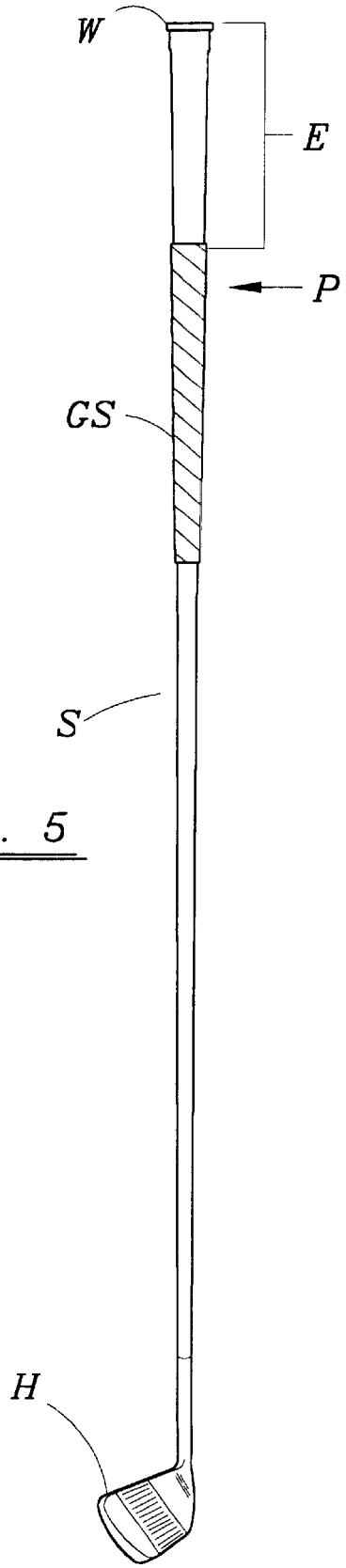
Figure 6:
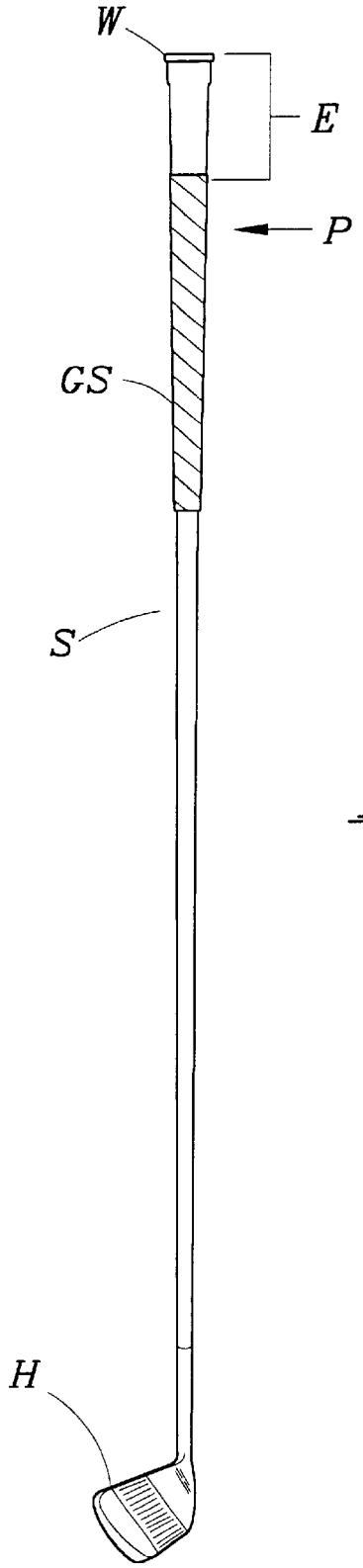
Figure 7:
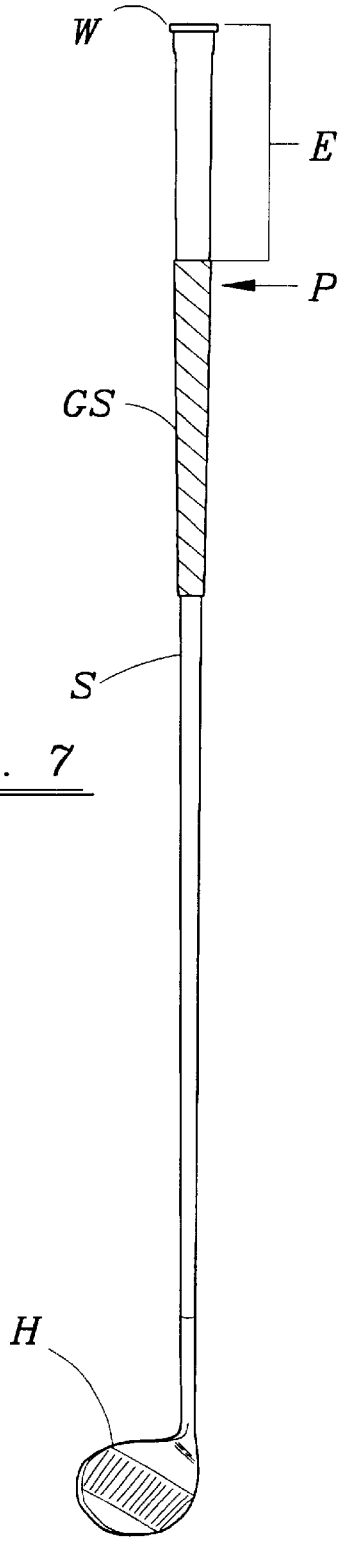
Figure 8:
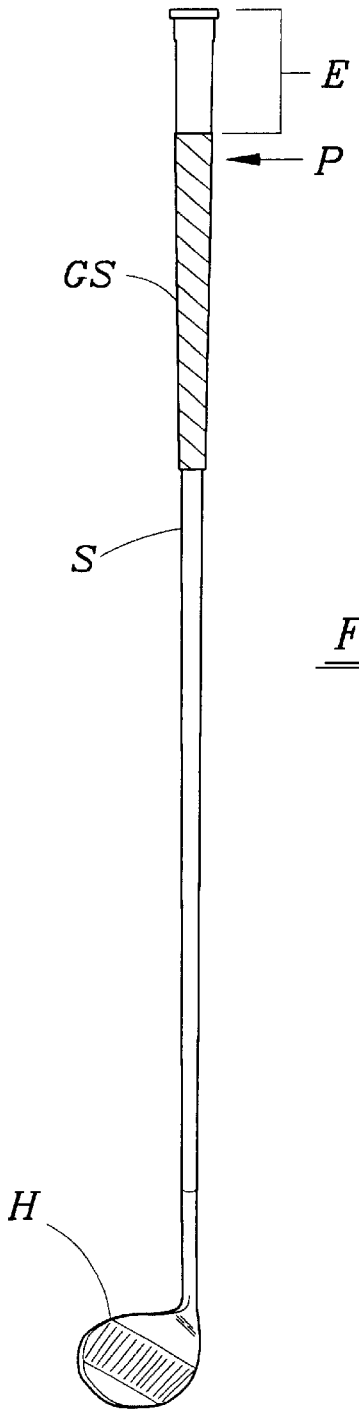

FIGS. 3 through 8 show various embodiments of the present invention in the form of irons, FIGS. 3 and 4 showing a long iron, approximately a 2 iron, FIGS. 5 and 6 showing a midiron, approximately a 5 iron, and FIGS. 7 and 8 showing a short iron, approximately a 9 iron or a wedge.

Figure 9:
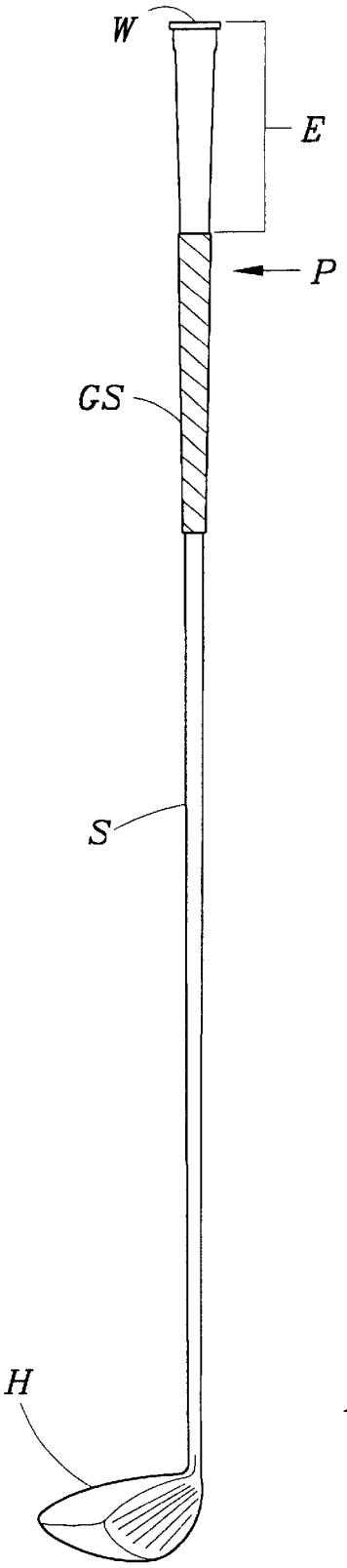
FIGS. 9 and 10 depict various embodiments of the club of the present invention wherein the golf club is what is commonly referred to as a wood.
Figure 10:
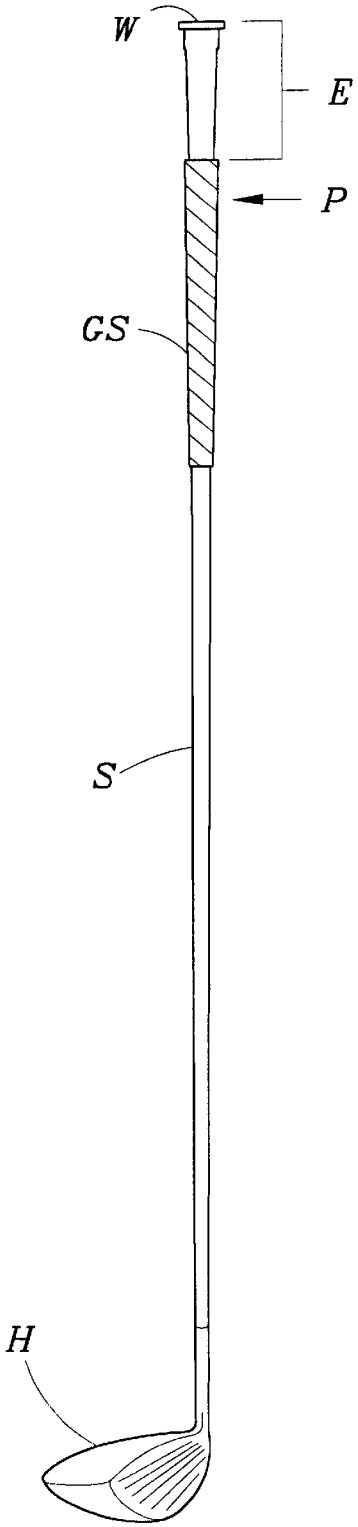

FIGS. 9 and 10 show the concept of the present invention as embodied in a golf club commonly referred to as a "wood", although numerous other materials besides wood, e.g., metal or combinations of metals, are now also employed for the club head of what is still conventionally referred to as a "wood" or even a "metal wood".

Figure 11:
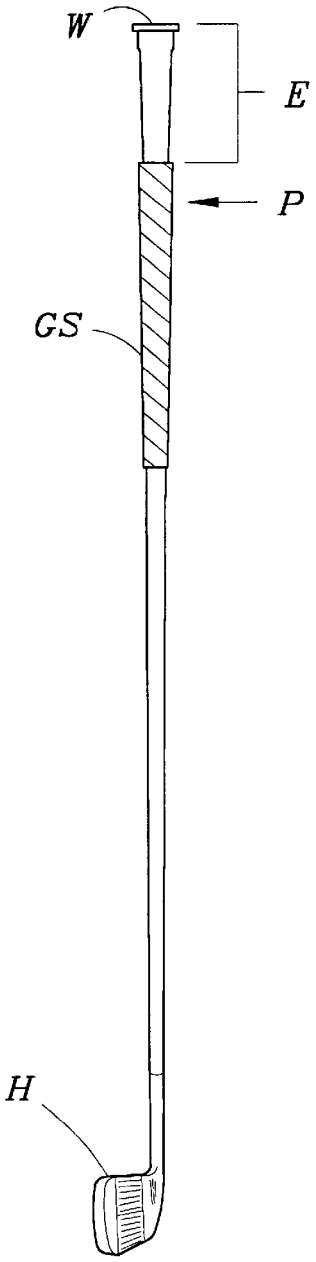
FIG. 11 shows an embodiment of the club of the present invention wherein the golf club is a putter.

FIG. 11 shows the concept of the present invention as embodied in a putter.

In all of the Figures, the letter H refers to the club head, S refers to the shaft above the shank or hosel, GS refers to the gripping surface, and P refers to the normal pivot point of the club as employed by a golfer gripping the club at the top end of the normal gripping surface thereof, whereas E refers to the extension of the club above and beyond the gripping surface and pivot point of the club and W refers to the weight affixed at the end of extension E.

The length of extension E is such that the weight W is spaced at least one inch above the top end of the club and the gripping surface thereof. The length of this extension may accordingly range from a minimum of one inch to about six inches. The weight affixed at the end of the extension is at least 25 grams and may be as great as 200 grams. The lengths of the extension and weights found most suitable by the inventor for effecting the desired improvement in swing weight are 50 and 100 gram weights disposed at the end of an extension having a length of three to five inches, although the exact weight involved and length of the extension will depend to some extent upon the characteristics and practices of the individual golfer and his individual swing technique.

In FIG. 3 the extension is shown as five inches and the weight is 100 grams. In FIG. 4 the extension is shown as three inches and the weight is 50 grams. The same is true for FIGS. 5 and 6 and 7 and 8, with the advantageous effect of placing the weight behind the golfer's hands being found by the present inventor to be greatest with the long irons and also greatest with the heavier weights and greater lengths of the extension with the long irons, and with the lesser weights and lengths of the extension in the shorter irons.

FIGS. 9 and 10 show woods respectively having a length of the extension of five inches and a weight of 100 grams and an extension of three inches and a weight of 50 grams.

FIG. 11 shows the corresponding putter and, although the swing of a putter is indeed different than that of other clubs, the displacement of the weight to provide a weight behind the hands of the golfer has been found to be of definite advantage by the inventor. Here also the length of the extension and the magnitude of the weight is considered to be maximally effective between three and five inches and 50 to about 100 grams, as shown three inches and 100 grams.

As stated, the weight W at the end of extension E may in any case be secured thereto in any suitable manner, as by cementing, swaging, taping, or even fusing therewith and therein and the weight may, as shown in FIG. 2, also comprise an exterior wrap on the outside of the hollow golf club shaft S, e.g., a lead wrap or winding LW, which if present may also comprise a portion of the weight W affixed to the end of hollow extension E.

OPERATION

In operation, the golf club of the present invention is employed in the same manner as any conventional golf club, with the player selecting his usual position on the gripping area for effectively gripping the club. Near the top end of the gripping surface, since the top of the club is normally the end of the gripping surface, is found the pivot point. The weight is spaced by the extension a distance above the club end, above the pivot point and toward the golfer and, in operation, provides the desired increase in the moment of inertia while decreasing the swing weight of the club, thus allowing the golfer to attain an increased velocity about the pivot point of the club with the same energy input or swing which he usually applies to a normal club. Adding weight at the hands or at the pivot point or at the very end of the club is found to be negative or at best to give no useful effect, whereas adding weight backwards, that is, spaced behind the hands, provides an improvement in swing weight along the lines previously stated.

For a particular golfer, the optimal distance of the weight above the club end and the optimal weight to be employed may be determined, as is usual for any other golf club, by practice swings and then by actual trial in a round of golf. However, as previously stated, for the present inventor, a golfer, an extension length of one to six inches and a weight of 25 to 200 grams was found to be satisfactory, with an extension of three to five inches and a weight of 50 to about 100 grams being preferred, with the shorter extension length and lesser weight being especially preferred for the shorter irons and usually also for his putter.

Although the present invention is not to be limited in any way by theory, as a result of the increased velocity attainable by the inventor, his distance off the tee is substantially improved. It is his theory that his advantageous results are obtained according to foregoing principles, and that the same advantageous result will be obtained by any other serious golfer after optimization of the extension length and weight to suit his own particular body weight, technique, and golf swing.

IN GENERAL

Of the several configurations disclosed herein, the present applicant has found that, for his particular swing, a five-inch extension and a 100 gram weight were preferred, although a three-inch extension with a 50 gram weight also provided a satisfactory improvement or advantage in swing weight, especially with the long irons, namely, the 1, 2, 3, 4, or 5 irons whereas, in his experience, the improvement according to the present invention with the shorter irons, such as the 6, 7, 8, 9, or various wedges, was clearly evident although not as pronounced but preferably utilized a shorter extension, e.g., of three inches. With the driver and fairway woods, the present applicant has found that modification of the club to provide an extension five inches in length and a weight of 100 grams was most suitable whereas, for a putter, to give an entirely different swing weight or feel thereto, a three-inch extension and a 50 gram weight was found to make a substantial difference although a three- or five-inch extension with a 100 gram weight was also considered to give a significant improvement. With respect to the woods, such can of course be either conventional or a metal wood of any kind or type, as many such clubs are appearing on the market in recent days, as will be readily apparent to one skilled in the art, so that the exact type of club head is really immaterial according to the present invention.

The portion of any extension spacing the weight the desired distance from the club end, as well as its adapter, to the extent that it is not inserted inside the end of the club shaft, where it may be secured by swaging, wedging, press fitting, splining, and ordinarily additional cementing, may advantageously be covered with the same material as the gripping surface, so as not to present a different outward appearance between the gripping surface and the extension and its added weight, although if desired the weight and/or its extension may be left uncovered or partially uncovered so as to give it the appearance of a separate element.

The weight may be of any suitable material such as lead, an alloy, or other metal or non-metallic composition, and if desired it may as stated be suitably covered or wrapped with plastic or natural or synthetic rubber or any other suitable material of the type usually employed for the gripping surface of the club, which is usually of wound leather or natural or synthetic rubber or other elastomeric material or composition, such as the type generally employed in any normal golf club. As also stated, the extension and/or weight may be uncovered or unwrapped, this being a matter of personal taste and decor and not of the essence of the present invention.

The weight and its essential extension is in any event provided in secured or fixed engagement with, or even integral with, the club shaft at the end of the club and the normal gripping surface thereof, which also means above the pivot point thereof. It is recognized that the pivot point of a rotating club is generally at the top finger of the top hand of the golfer or under his finger at the furthest distance from the club head. The "pivot point" of any golf club can of course be changed by the golfer by moving his hands upwardly or downwardly on the gripping surface of the golf club shaft. If a golfer tends to shift his grip or hands downwardly on the gripping surface of the club, then his actual pivot point will be lower than the top end of the gripping surface. In such case the spacing of the weight from his hands or grip may be minimized rather than maximized by shortening the length of the extension employed, although here again according to the present invention and description, the length of the extension involved is stated from the upper end of the gripping surface of the club, which is ordinarily also the upper end of the club, and not from the pivot point thereof.

It is therefore seen that a golf club having an advantageous weight distribution and having an extension beyond the normal club end which places a weight behind the golfer's hands so as to change the swing weight of the club, and whereby all of the objectives of the invention have been attainted, has been provided by the present invention, as well as an adapter for converting a normal golf club into a gold club having the advantageous weight distribution according to the present invention.

It is to be understood that the present invention is not to be limited to the exact details of operation, or to the exact embodiments shown and described, as various modifications and equivalents will be apparent to one skilled in the art, wherefore the present invention is to be limited only by the full scope which can be legally accorded to the appended claims.

I claim:

1. A golf club consisting of a head end and a handle or gripping end and a hollow shaft therebetween, an elongated hollow tubular extension of the hollow shaft at the handle or gripping end thereof and beyond the gripping surface thereof, said extension being one to six inches in length and carrying a weight of 25 to 200 grams fixedly secured at the end thereof, said extension and said weight being aligned with the vertical or longitudinal axis of the shaft of the club, said extension spacing the weight upwardly beyond the gripping surface of the club and thus behind the golfer's hands upon gripping the club and above the pivot point of the club during the golfer's swing.

2. A golf club of claim 1, wherein the extension is provided as a continuation of the hollow shaft of the golf club itself which extends beyond the gripping surface thereof.

3. A golf club of claim 1, wherein the extension is provided with adapter means axially aligned therewith of an additional length sufficient to enable its securement at the end of the hollow golf club shaft for fixed engagement therewith in alignment with the vertical or longitudinal axis of said golf club shaft.

4. A golf club of claim 3, wherein the adapter means fits inside the end of a hollow golf club shaft and is fixedly secured therein.

5. A golf club of claim 1, wherein the length of the extension is about three to about five inches and the weight is about 50 to about 100 grams.

6. A golf club of claim 1, wherein the club is an iron.

7. A golf club of claim 1, wherein the club is a wood.

8. A golf club of claim 1, wherein the club is a putter.

9. An elongated tubular extension, for the handle or gripping end of a golf club consisting of a hollow shaft, said extension being one to six inches in length and carrying a weight of 25 t0 200 grams fixedly secured at one end thereof, said extension having at the other end thereof adapter means axially aligned therewith of an additional length sufficient to enable its securement at the end of the hollow golf club shaft for fixed engagement therewith in alignment with the vertical or longitudinal axis of said golf club shaft.

10. An extension of claim 9, wherein the adapter is designed for securement within the end of a hollow golf club shaft for fixed engagement therewith.

11. An extension of claim 9, wherein the length of the extension is about three to about five inches and wherein the weight is about 50 to about 100 grams.

* * * * *